US011643168B1

(12) United States Patent
Cataluna

(10) Patent No.: US 11,643,168 B1
(45) Date of Patent: May 9, 2023

(54) THROUGH-HULL PASSIVE INBOARD HYDRO-GENERATOR FOR A MARINE VESSEL

(71) Applicant: Victor Rafael Cataluna, Hallandale Beach, FL (US)

(72) Inventor: Victor Rafael Cataluna, Hallandale Beach, FL (US)

( * ) Notice: Subject to any disclaimer, the term of this patent is extended or adjusted under 35 U.S.C. 154(b) by 0 days.

(21) Appl. No.: 17/713,779

(22) Filed: Apr. 5, 2022

(51) Int. Cl.

| | |
|---|---|
| ***F03B 3/04*** | (2006.01) |
| ***F03B 13/00*** | (2006.01) |
| ***B63B 1/04*** | (2006.01) |
| ***B63B 19/00*** | (2006.01) |
| ***B63B 79/40*** | (2020.01) |

(52) U.S. Cl.
CPC ..... *B63B 1/042* (2013.01); *B63B 19/00* (2013.01); *B63B 79/40* (2020.01); *F03B 3/04* (2013.01); *F03B 13/00* (2013.01)

(58) Field of Classification Search
CPC ..... F03B 3/04; F03B 13/00
See application file for complete search history.

(56) References Cited

U.S. PATENT DOCUMENTS 1,898,973 A * 2/1933 Lansing ..... B63J 3/04 440/6
1,934,487 A * 11/1933 Davison ..... F01K 7/025 60/711
2,246,472 A * 6/1941 Sharp ..... F03B 3/103 405/75
2,617,703 A * 11/1952 Minkler ..... F42B 19/36 250/214 R
3,143,972 A * 8/1964 Smith ..... B63H 11/08 440/47
3,263,643 A * 8/1966 Tattersall ..... B60V 1/115 60/221
3,422,788 A * 1/1969 Horan, Jr. ..... B63H 11/11 60/222
3,870,893 A * 3/1975 Mattera ..... F03B 13/183 290/53
3,943,876 A * 3/1976 Kiekhaefer ..... B63H 20/02 440/43
4,224,527 A * 9/1980 Thompson ..... F03B 17/06 290/43

(Continued)

FOREIGN PATENT DOCUMENTS

| | | |
|---|---|---|
| DE | 102014016269 | 5/2016 |
| KR | 101389605 | 4/2014 |

*Primary Examiner* — Tulsidas C Patel
*Assistant Examiner* — Thomas K Quigley
(74) *Attorney, Agent, or Firm* — The Concept Law Group, PA; Scott D. Smiley; Scott M. Garrett

(57) ABSTRACT

A passive generator system for a marine vessel using an intake manifold having an opening at the bottom of the hull of the vessel. The intake manifold tapers to a point at the rear of the opening and extends upward to an intake funnel that reduces down to a conduit. The conduit has a first portion angled relative to the opening which joins to a second portion at an elbow. The second portion of the conduit extends horizontally to a rear of the vessel, to a conduit exit where water can exit the conduit. An impeller is location in the first portion of the conduit that drives a generator through a shaft between the impeller and the generator, the shaft passing through a top of the first portion of the conduit.

14 Claims, 11 Drawing Sheets

(56) References Cited

U.S. PATENT DOCUMENTS 4,252,075 A * 2/1981 Kobayashi ..... B63H 11/11 440/43
4,302,682 A * 11/1981 LaCoste ..... F03G 7/05 203/88
4,315,749 A * 2/1982 Baker ..... B63H 11/11 60/221
4,345,159 A * 8/1982 Gutierrez Atencio .. F03B 13/08 290/43
4,364,228 A * 12/1982 Eller ..... F03B 13/08 137/143
4,474,561 A * 10/1984 Haglund ..... B63H 11/11 60/221
4,643,685 A * 2/1987 Nishida ..... B63H 21/32 60/221
4,718,870 A * 1/1988 Watts ..... F04F 5/461 60/221
4,868,408 A * 9/1989 Hesh ..... F03B 17/061 415/908
4,917,637 A * 4/1990 Soga ..... B63H 11/113 60/221
5,123,867 A * 6/1992 Broinowski ..... B63H 11/08 440/38
5,152,704 A * 10/1992 Carlson ..... B63H 11/08 440/38
5,234,361 A * 8/1993 Dickinson ..... B63H 11/10 440/47
5,490,768 A * 2/1996 Veronesi ..... F04D 13/0646 417/423.12
5,512,787 A * 4/1996 Dederick ..... F03D 9/25 290/55
5,556,314 A * 9/1996 Fukuda ..... F01N 13/004 440/38
5,713,769 A * 2/1998 Jones ..... B63H 11/08 440/38
5,720,636 A * 2/1998 Burg ..... B63H 11/11 440/43
5,759,074 A * 6/1998 Jones ..... F16D 3/185 440/38
6,027,383 A * 2/2000 Broinowski ..... B63H 11/113 440/38
6,132,269 A * 10/2000 Belt ..... B63H 21/32 440/38
6,267,551 B1 * 7/2001 Dentinger ..... F03B 3/126 415/214.1
6,722,934 B2 * 4/2004 Roos ..... B63H 21/32 440/38
7,021,905 B2 * 4/2006 Torrey ..... F04C 15/008 310/63
7,143,707 B2 * 12/2006 Becker ..... B63H 11/102 114/151
7,226,324 B2 * 6/2007 Roos ..... B63H 11/06 440/38
7,235,894 B2 * 6/2007 Roos ..... F03B 13/264 290/54
7,385,303 B2 * 6/2008 Roos ..... F03B 13/105 290/54
7,524,220 B2 * 4/2009 Fuse ..... B63H 11/08 415/173.1
8,536,723 B2 * 9/2013 Roos ..... F03B 3/18 290/55
8,911,271 B2 * 12/2014 Shibayama ..... B63H 11/08 440/38
8,963,356 B2 * 2/2015 Roos ..... F03B 13/083 290/52
10,428,786 B2 * 10/2019 Navarro ..... F16D 31/02
10,583,707 B2 3/2020 Kaskowicz
10,597,129 B1 * 3/2020 Broinowski ..... F01N 13/004
10,619,620 B2 4/2020 Skjoldhammer
2004/0207209 A1 * 10/2004 Rammler ..... F03B 13/105 290/54
2005/0236842 A1 * 10/2005 Alstot ..... F03G 7/005 290/54
2006/0003643 A1 * 1/2006 Becker ..... B63H 11/08 440/38
2006/0043738 A1 * 3/2006 Roos ..... F03B 3/103 290/54
2007/0096472 A1 * 5/2007 Mondl ..... F03B 13/26 290/54
2007/0145751 A1 * 6/2007 Roos ..... F03B 13/105 290/52
2009/0134623 A1 * 5/2009 Krouse ..... F03B 13/08 415/4.1
2010/0038910 A1 * 2/2010 da Silva ..... H02K 7/1823 290/52
2010/0181771 A1 * 7/2010 Roos ..... H02K 7/1823 290/52
2010/0308591 A1 * 12/2010 Godfrey ..... F03B 13/00 290/54
2011/0109089 A1 * 5/2011 Frye ..... F03B 13/10 290/54
2011/0133467 A1 * 6/2011 Stiles ..... F03D 1/04 290/55
2012/0169054 A1 * 7/2012 Roos ..... H02K 1/278 290/52
2019/0101095 A1 * 4/2019 Navarro ..... F04B 17/00

* cited by examiner

THROUGH-HULL PASSIVE INBOARD HYDRO-GENERATOR FOR A MARINE VESSEL

FIELD OF THE INVENTION

The present invention relates generally to electric generators, and, more particularly, relates to a passive hydro-powered generator system for marine applications.

BACKGROUND OF THE INVENTION

Many marine vessels use electric power for a variety of applications, including, for example, electronic navigation systems, sonar systems for depth/fish finding, climate control systems, engine starting, engine lift, trim systems, and so on. Further, there are also electrical motor used on vessels that range from conventional trolling motors to the main propulsion system. Battery systems are used to provide a reservoir of electric power, and in more sophisticated vessels, particularly those with in-board motor systems, a generator can provided to recharge the battery. Typically the in-board propulsion system is an internal combustion engine that can drive a generator system as well as a propeller. Alternatively, electric motors can be used as the main propulsion system. Vessels outfitted for live-aboard conditions may include a separate generator, as well as solar panels, wind-driven generators, and/or towed or transom mounted hydro generators that can be used to replenish charge in the vessel's battery system. However these systems can be cumbersome to install and maintain.

Therefore, a need exists to overcome the problems with the prior art as discussed above.

SUMMARY OF THE INVENTION

In accordance with some embodiments of the inventive disclosure, there is provided a passive marine electrical generator that includes an intake manifold that has an opening. The opening has an area, and a wall surrounding the opening that extends upward from the opening and reduces to an intake manifold exit that is positioned over a rear of the opening. There is further included a funnel member coupled to the intake manifold exit that reduces from the intake manifold exit and that extends upwards and to the rear of the intake manifold to a funnel member exit. The generator system further includes a conduit having a first portion coupled to the funnel member exit, where the first portion extends further upward and to the rear of the intake manifold to an elbow transition, and then to a second portion which extends horizontally in a direction away from the intake manifold to a conduit exit. The passive marine generator system further includes an impeller disposed in the first portion of the conduit proximate to the funnel exit, and a shaft coupled to a center of the impeller at a first end of the shaft, the shaft extends from the impeller upward along the first portion of the conduit and through a sealed opening in a top of the elbow transition. A generator is mounted on top of the conduit and is coupled to a second end of the shaft.

In accordance with a further feature, the first portion of the conduit is angled at forty degrees relative to the opening of the intake manifold, with a range of +/−five degrees.

In accordance with a further feature, the opening of the intake manifold has a front edge and sides extending from the front edge to a point at a back of the opening.

In accordance with a further feature, the intake manifold opening has a five sided shape including a rectangular portion comprised of the front edge and having parallel opposing sides that extend towards the back of the opening to a triangular portion having sides that meet at the point centrally at the back of the opening.

In accordance with a further feature, the point at the back of the opening is positioned behind the funnel portion.

In accordance with a further feature, the parallel opposing sides extend from the front edge to halfway to the back of the opening.

In accordance with a further feature, there is further included a screen over the opening of the intake manifold.

In accordance with a further feature, the conduit exit is positioned to be above a resting water line.

In accordance with a further feature, the intake manifold has a top wall that extends at an angle from the front edge toward the intake funnel, wherein the top wall becomes rounded from in a direction parallel to the front edge where it meets the intake funnel.

In accordance with a further feature, there is further included a battery controller, a first battery bank, a second battery bank, and the charge controller is configured to switch connections of the first and second battery to the generator based on a charge state of the first and second battery banks.

In accordance with some embodiments of the inventive disclosure, there is provided a marine vessel that includes a hull having a bottom and a transom at a rear of the hull. The marine vessel further includes an intake manifold mounted at the bottom of the hull and which has an opening co-located over an opening in the hull. The opening of the intake manifold has an area, and a wall surrounding the opening of the intake manifold that extends upward from the opening of the intake manifold and which reduces in area to an intake manifold exit that is positioned over a rear of the opening of the intake manifold. The vessel further includes a funnel member coupled to the intake manifold exit that reduces in area from the intake manifold exit that extends upwards and to the rear of the intake manifold to a funnel member exit. The vessel further includes a conduit having a first portion coupled to the funnel member exit which extends further upward and to the rear of the intake manifold to an elbow transition and then to a second portion which extend horizontally to the rear and in a direction away from the intake manifold to a conduit exit at the transom of the hull. The vessel further has an impeller disposed in the first portion of the conduit proximate to the funnel exit, a shaft coupled to a center of the impeller at a first end of the shaft, the shaft extends from the impeller upward along the first portion of the conduit and through a sealed opening in a top of the elbow transition, and a generator mounted on top of the conduit that is coupled to a second end of the shaft.

In accordance with a further feature, the first portion of the conduit is angled at forty degrees relative to the opening of the intake manifold.

In accordance with a further feature, the opening of the intake manifold has a front edge and sides extending from the front edge to a point at a back of the opening.

In accordance with a further feature, the intake manifold opening has a five sided shape including a rectangular portion comprised of the front edge and having parallel opposing sides that extend towards the back of the opening to a triangular portion having sides that meet at the point centrally at the back of the opening.

In accordance with a further feature, the point at the back of the opening is positioned behind the funnel portion.

In accordance with a further feature, the parallel opposing sides extend from the front edge to halfway to the back of the opening.

In accordance with a further feature, there is further included a screen over the opening of the intake manifold.

In accordance with a further feature, the conduit exit is positioned to be above a resting water line.

In accordance with a further feature, the intake manifold has a top wall that extends at an angle from the front edge toward the intake funnel, wherein the top wall becomes rounded from in a direction parallel to the front edge where it meets the intake funnel.

In accordance with a further feature, there is further included a battery controller, a first battery bank, a second battery bank, and the charge controller is configured to switch connections of the first and second battery to the generator based on a charge state of the first and second battery banks.

Although the invention is illustrated and described herein as embodied in a through-hull passive mariner generator system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the element being described. The terms "program," "software application," and the like as applicable herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
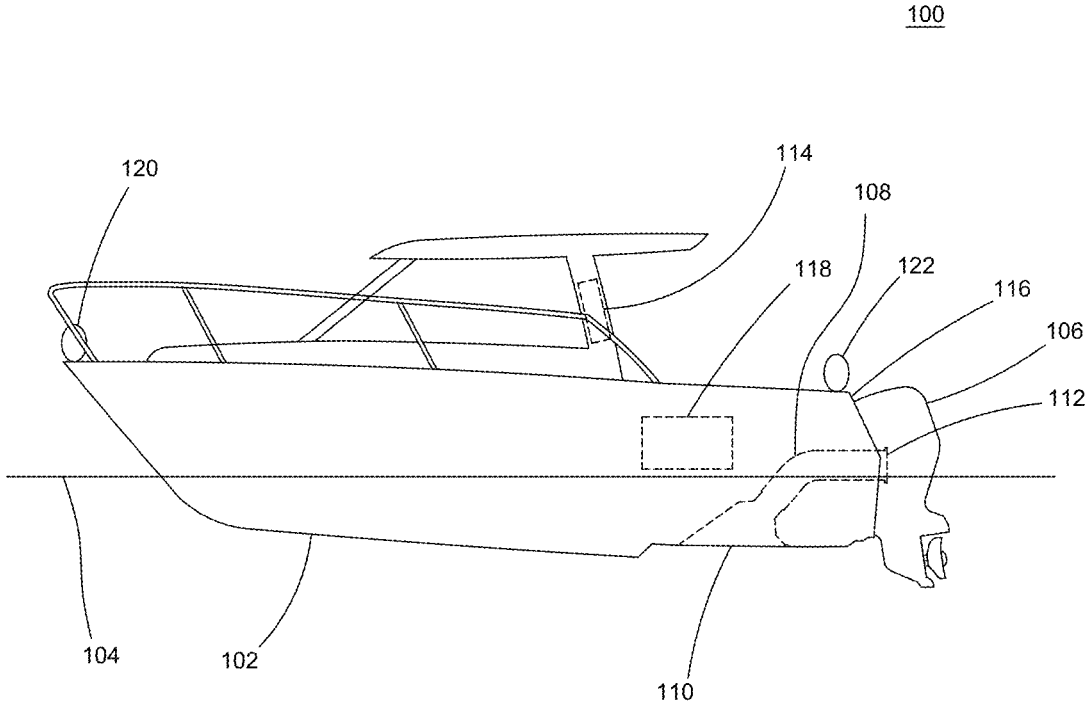
FIG. 1 is a side view of a marine vessel having a through-hull passive electric generator, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 8:
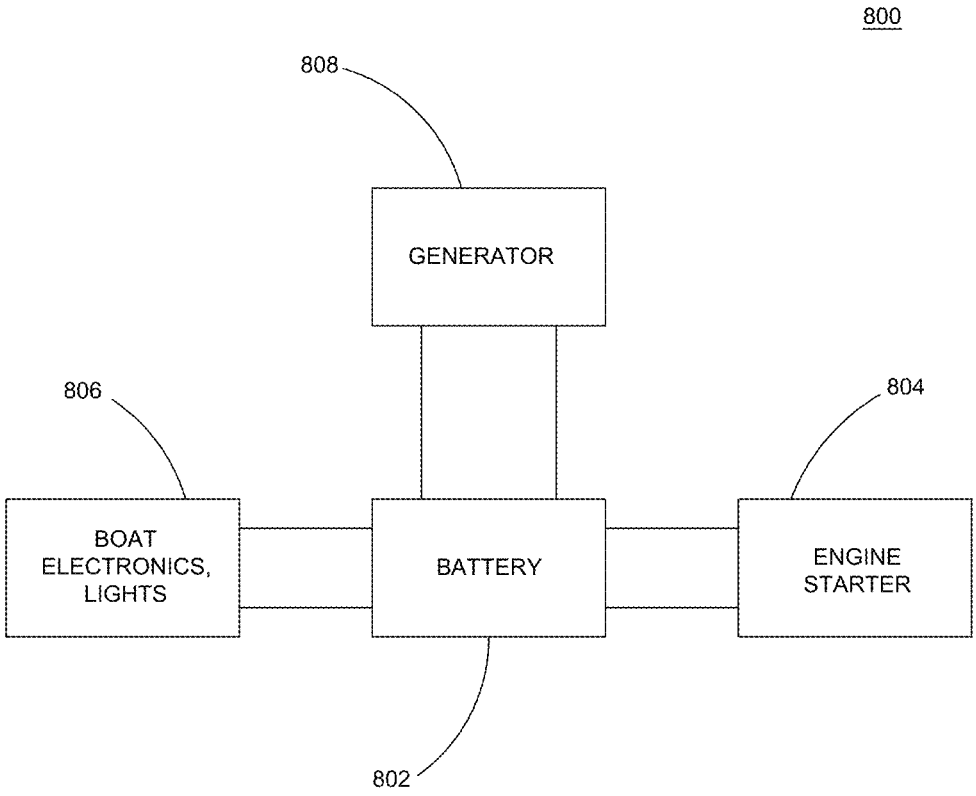
FIG. 8 shows a vessel schematic diagram, in accordance with some embodiments

FIG. 1 is a side view of a marine vessel 100 having a through-hull passive electric generator, in accordance with some embodiments. In particular, the vessel is a boat having a hull 102 that sits in the water, and is powered by an outboard motor 106 that is mounted at the transom 116 of the vessel 100. The outboard motor 106 is generally a self-contained system but requires an external battery 118 to provide electric power for the starter of the outboard motor 106, or for propulsion operation of an electric motor. The boat may also have electronic systems 114 operated by the battery 118, such as, for example, radio communication, radar, depth/fish finder, as well as running lights 120, 122. Since all of these devices and the outboard motor 106 depend on the battery 118, it is imperative that the battery 118 be charged and able to provide power, or that at least an additional power source is present that can provide power in order to avoid being without communications, navigation, or light. FIG. 8 shows a vessel schematic diagram as an example. Briefly, a battery 802 is used to power an engine starter 804 motor for the outboard engine (e.g. 106), as well as various vessel electronics and the vessel lights 806. As both the engine starter 804 and vessel electrical system 806 consume energy from the battery 802, a generator 808 is required to charge the battery 802.

The through-hull passive generator system employs a specialized water conduit system that has an intake manifold 110 at the bottom of the hull 102 that forces water through a generator conduit 108 and out through the side of the hull or the transom 116 at the exit 112, which is generally above the resting water line 104 of the vessel 100, when the vessel is not moving. The intake manifold 110 is positioned at an opening in the bottom of the hull 102. As the boat begins to move, propelled by the outboard motor 106, the design of the intake manifold creates a pressure differential that forces water through the generator conduit 108. The water flowing through the generator conduit 108 causes an impeller disposed in the generator conduit to turn.

Figure 2:
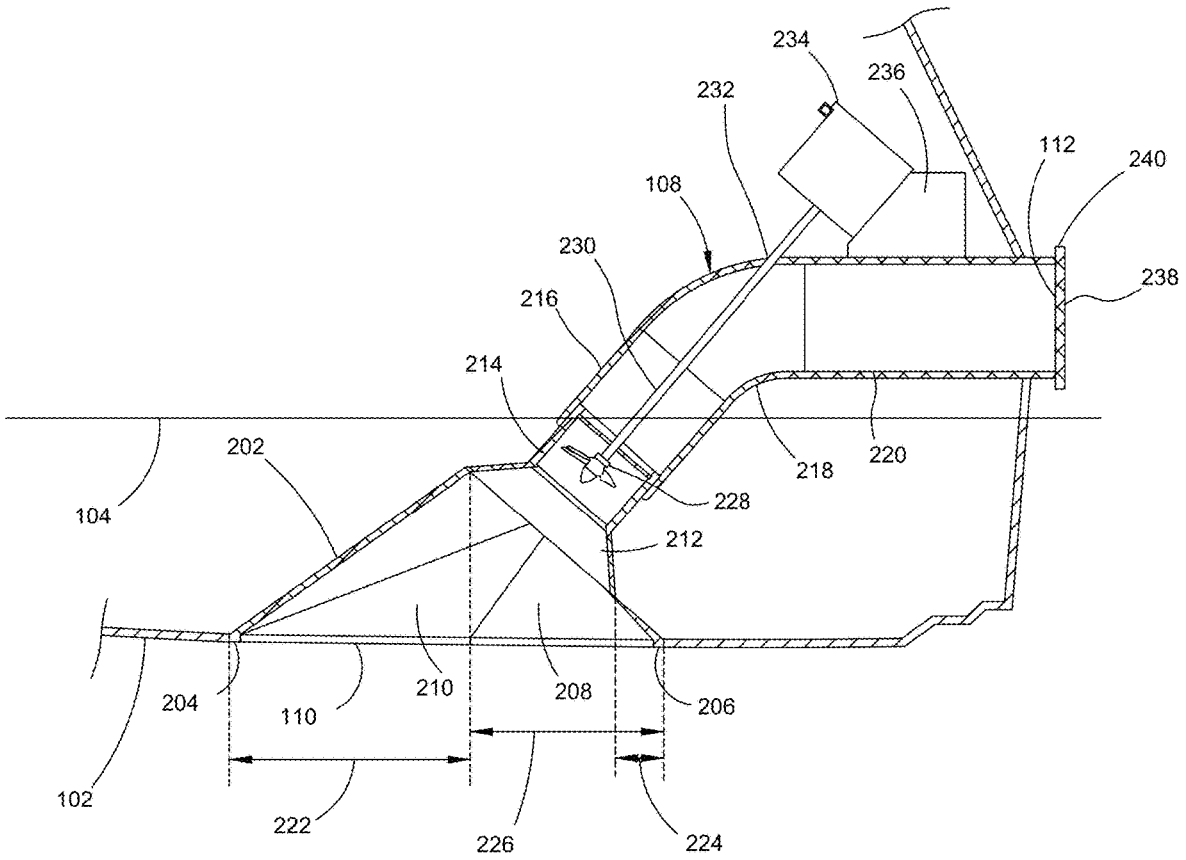
FIG. 2 shows a side cut-away view of a through-hull passive generator, in accordance with some embodiments.
Figure 3:
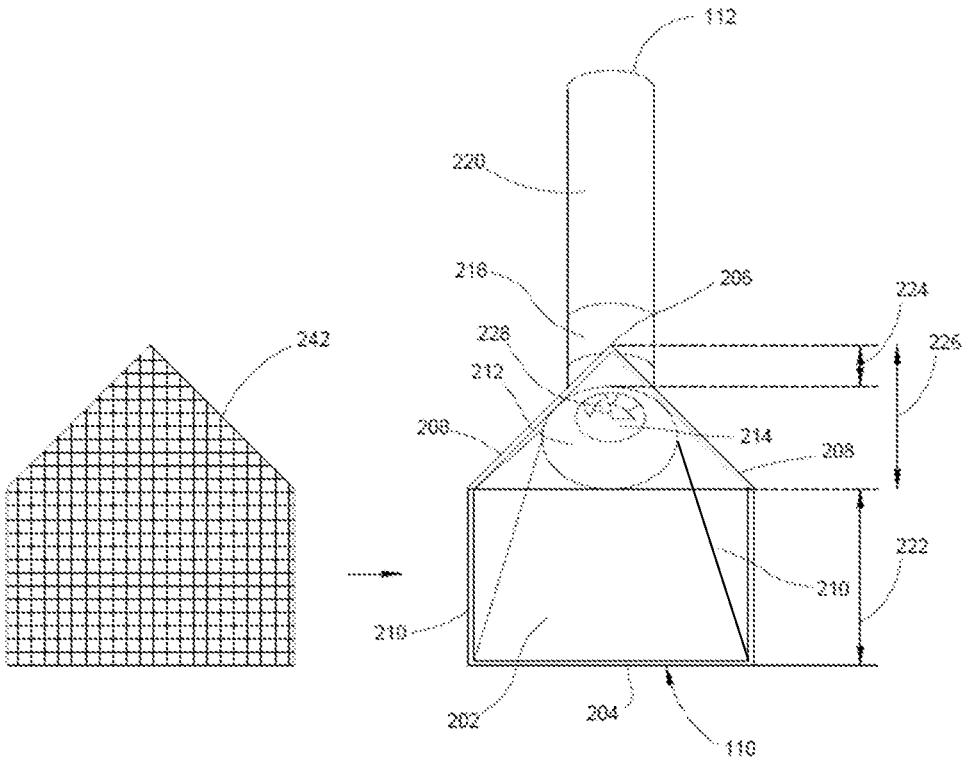
FIG. 3 shows a bottom view of a passive generator for marine vessels, in accordance with some embodiments.
Figure 4:
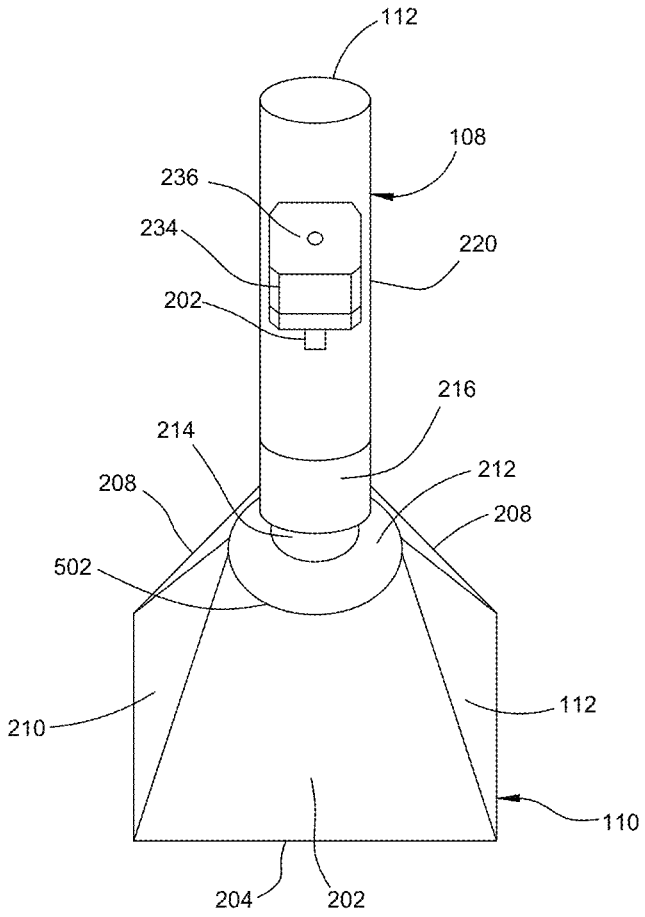
FIG. 4 shows a top view of a passive generator for marine vessels, in accordance with some embodiments.
Figure 5:
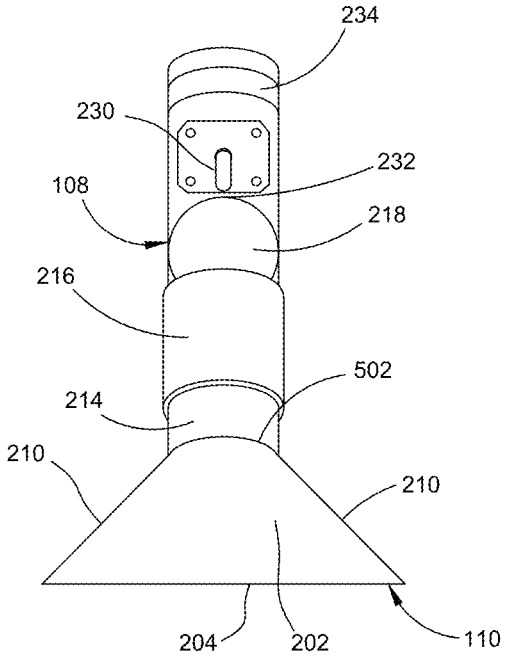
FIG. 5 shows a front view of a passive generator, including a barrier over the intake, for marine vessels, in accordance with some embodiments.

FIG. 2 shows a side cut-away view of a through-hull passive generator system, in accordance with some embodiments. The view here is along a central plane in a direction from the front of the vessel to the rear of the vessel. FIGS. 3-5 show other views of the through passive generator system. In these figures, the intake manifold is shown having a tapered opening at the bottom of the vessel. The opening of the intake manifold 110, for example, has a front edge 204 having a width, and tapers to a rear point 206. Forward side walls 210 extend from the front edge 204 towards the rear about halfway across the total distance of the opening from front to rear. Rear sidewalls 208 extend from the forward sidewalls 210 at an angle to the rear point 206. The angle can be about forty degrees relative to the direction of the forward side walls 210, with a tolerance of +/−five degrees in some embodiments. A top wall 202 of the intake manifold 110 extends from the front edge 204 over the opening and upward to an intake funnel 212 at the top of the intake manifold, and generally behind the centerline, from front to rear, where the forward side walls 210 meet the rear sidewalls 208 at the opening (bottom) of the intake manifold 110. The distance from the front edge 204 to the centerline is given by arrow 222. The rear point 206 is behind, from front to rear, of the bottom and rear of the intake funnel 214 by distance 224. Distance 226 indicates the distance from the centerline to the rear point 206 in the front to rear direction. The top wall 202 is relatively flat at the front edge 204, but narrows and becomes convex at the back of the tope wall where it meets the intake funnel 212.

The intake funnel has an opening at the top of the intake manifold 110, starting at about the centerline, and a funnel section 212 that reduces in diameter to a coupling section 214 that is coupled to the first section 216 of the generator conduit 108. The first section 216 of the generator conduit 108 is a tubular section of conduit angled upward at about a forty degree angle, but can be less or slightly more (e.g. +/−10%). The first portion 216 is joined to an elbow portion 218 that curves to meet the exit portion 220 of the generator conduit 108 that terminates at exit 112 of the generator conduit 108. The exit 112 of the generator conduit 108 can be covered with a cover 238 that is biased to a closed position by a spring 240. A screen or mesh 242 can be used to cover the intake opening to prevent objects in the water from entering the intake manifold 110. As can be seen here, the conduit exit 112 can be completely above the resting water line 104.

An impeller 228 is disposed in the first portion 216 proximate to the coupling section 214 of intake funnel. The impeller is coupled to a shaft 230 that runs along the first portion 216 and exits the top of the elbow section 218 at sealed opening 232, and is further coupled to a generator motor 234 that is mounted on a base 236. In general, when the vessel begins to move, water pressure forces water up through the intake manifold 110 and generator conduit 108, acting on the impeller 228 and causing it, and the shaft 230 to rotate, which in turn rotates the armature of the generator motor 234 to generate electricity. The forward motion of the vessel, as pushed by the outboard motor 106, combined with the particular geometry of the intake manifold 110 and the tapered opening of intake manifold 110 result in sufficient pressure to force water up and through the generator conduit 108. That force can also displace the cover 238, causing the cover 238 to be deflected open to allow water diverted through the generator conduit 108 to pass and exit out of the generator conduit 108.

As can be seen in FIG. 3, the intake opening of the intake manifold 110 is shown here as following a five sided shape including a rectangular portion comprised of the front edge 204, which is the bottom of the top wall 202, and the bottoms of the two forward side walls 210 at opposite sides of the front edge 204 and at right angles to the front edge. The bottom of the forward side walls extend back from the front edge to a point that is about halfway (distance 222) to the rear point 206 from the front edge 204 (in a line normal to the front edge 204). Where the bottoms of the forward side walls 210 end the bottoms of the rear side walls 208 extend therefrom to the rear, meeting at the rear point 206 to form a triangular section of the opening that is contiguous with the rectangular portion in the forward region of the intake opening. The width of the front edge 204 can be about twice that of distance 222 and distance 226. FIGS. 4 and 5 show a top view and a front view of the intake manifold 110 and the generator conduit 108. In these views the generator 234 and shaft 232 can be seen on top of the generator conduit 108. In FIG. 5 it can be seen that the top wall 202 has a rounded upper portion 502 that follows the opening of the intake funnel 212 and transitions from a rounded profile to a flat, linear edge at front edge 204. Further, the forward side walls 210 and rear side walls 208 are shown here as flat surfaces. However, it should be understood by those skilled in the art that similar shapes that use more rounded/curved surfaces can be used equivalently.

Figure 6:
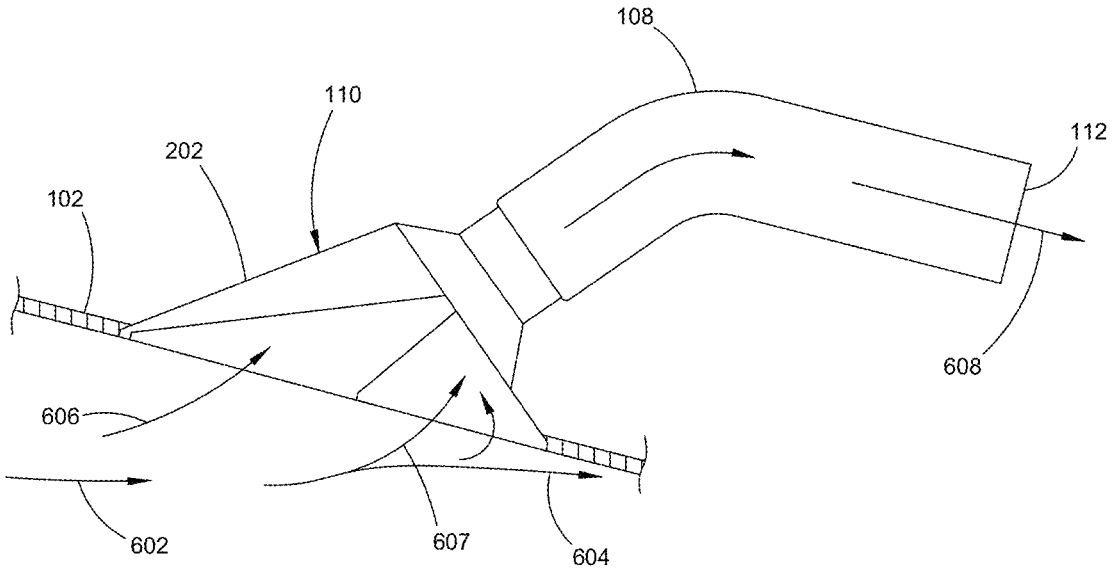
FIG. 6 shows an initial flow of water through the through-hull passive generator as the marine vessel begins moving through water, in accordance with some embodiments.
Figure 7:
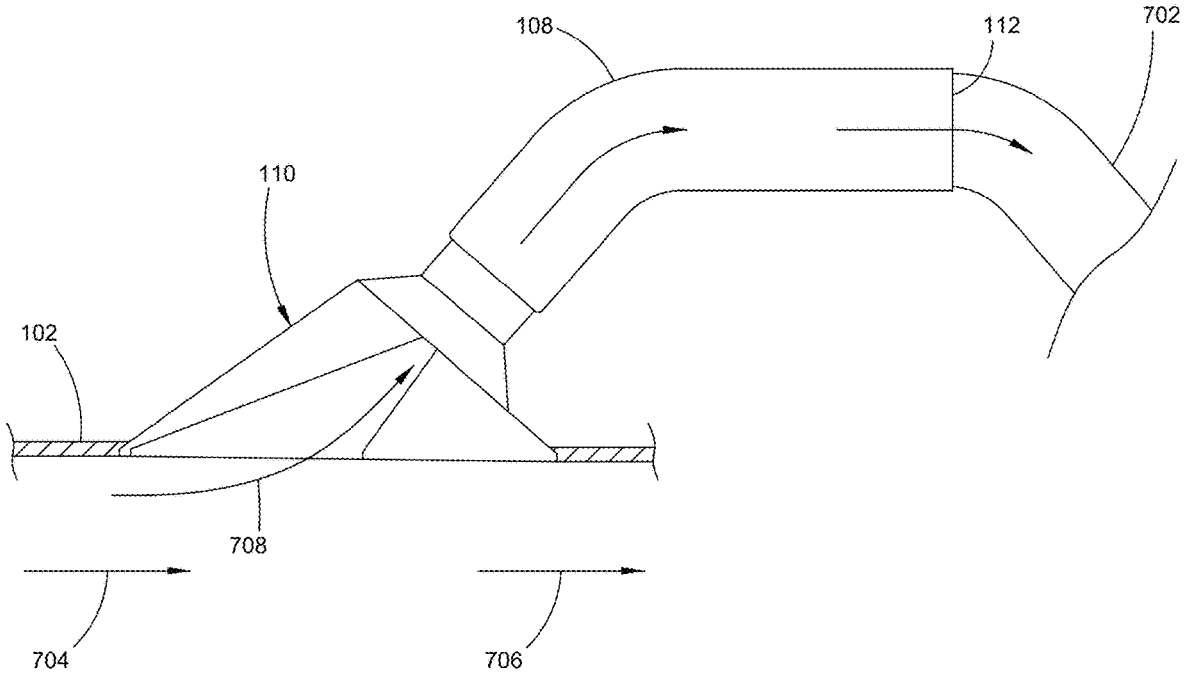
FIG. 7 shows a steady state operational position of the marine vessel and through-hull passive generator, in accordance with some embodiments.

FIGS. 6 and 7 show water flow through the intake manifold as the vessel begins to move (FIG. 6) and as the vessel is at a cruising speed (FIG. 7). Initially, when a boat is not moving, the hull sits in the water such that the water level comes the side of the boat to the water line 104. Upon engaging the outboard engine 106 the front of the boat will rise as the rear of the boat pushes through the water, creating an angle of the hull 102 relative to the direction of travel 602 as shown in FIG. 6. Water pressure will increase against the bottom of the hull 102, resulting in water flow 606 into the intake manifold, and water pressure at the rear of the opening of the intake manifold 110 created by the narrowing/tapered geometry of the rear portion of the opening of the intake manifold 110 results in a further upward flow 607, and as a result, water is displaced through the generator conduit 108 until it exits the conduit as indicated by arrow 608. This water flow can turn the impeller 228 and shaft 230, and then the generator armature, to create electricity that can be used to charge the battery (e.g. 802). Thus, the action of the boat upon moving and the geometry of the intake manifold act to create a flow of water through the generator conduit. Once this flow of water is established, and the boat continues increasing in speed, the boat will be on plane, and the water line relative to the hull will be far below the resting water line 104. This situation is shown in FIG. 7.

FIG. 7 illustrates a state where the boat is moving through the water on plane. In that state, the front of the boat and the rear of the boat are more even or level, and bottom of the hull 102 is less angled relative to the surface of the water relative to when it is moving slowly as in FIG. 6. However, because water was forced through the generator conduit 108 initially, there is an exit water flow 702 out of the exit 112 of the generator conduit 108. The momentum of that water flow creates a pressure differential at the opening of the intake manifold 110, which combined with the pressure differential resulting from the opening of the intake manifold 110 continues to move water through the generator conduit 108, turning the generator armature in the process.

Figure 9:
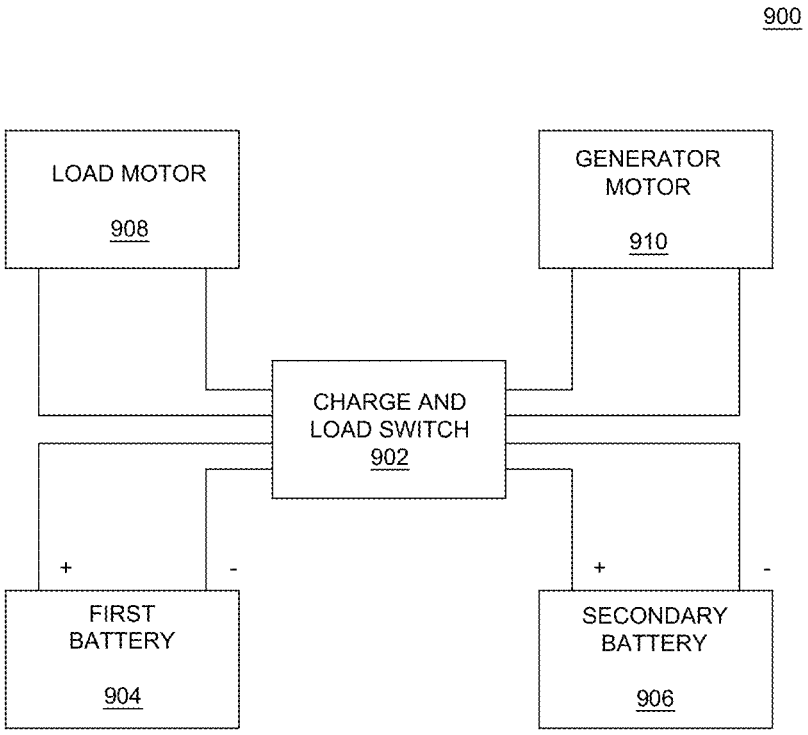
FIG. 9 shows a block diagram of a battery system including a load, a through-hull passive generator, and battery banks where connection of the load and generator is controlled by a charge controller, in accordance with some embodiments.

FIG. 9 shows a block diagram of a battery system 900 including a load, a through-hull passive generator, and battery banks where connection of the load and generator is controlled by a charge controller, in accordance with some embodiments. The system 900 includes a first battery bank 904 and a second battery bank 906, each of which are separately coupled to the charge controller 902. A load motor 908 is further connected to the charge controller 902 and is configured to provide vessel propulsion. A generator motor 910 is substantially similar to generator motor 234 and is coupled to a through-hull system substantially equivalent to that shown in FIGS. 1-5. As an example, the charge controller 902 can first connect the load motor 908 to battery bank 904 and the generator motor 910 to the other battery bank 906. In this configuration, load motor 908 will drain charge from the first battery bank 904 while the second battery bank 906 is charged (or maintained at a charged level if already charged) by the generator 10. Once the load motor 908 depletes the first battery bank 904, the charge controller switches the connections such that the load motor 908 is then connected to the second battery bank 906 and the generator 910 is connected to the first battery bank 904 and recharges the first battery bank 904. The system 900 is a replacement of a single battery bank system without any recharge capability. Then when the second battery reaches a discharge threshold, the charge controller 902 switches back to the initial configuration, and the cycle repeats until both batteries are discharged. Since the generator motor 910 is powered by movement of the vessel, it simply recovers some energy based on water pressure against the hull of the vessel. As a result, the system gains efficiency by achieving some replenishment, but eventually both battery banks become discharged.

Figure 10:
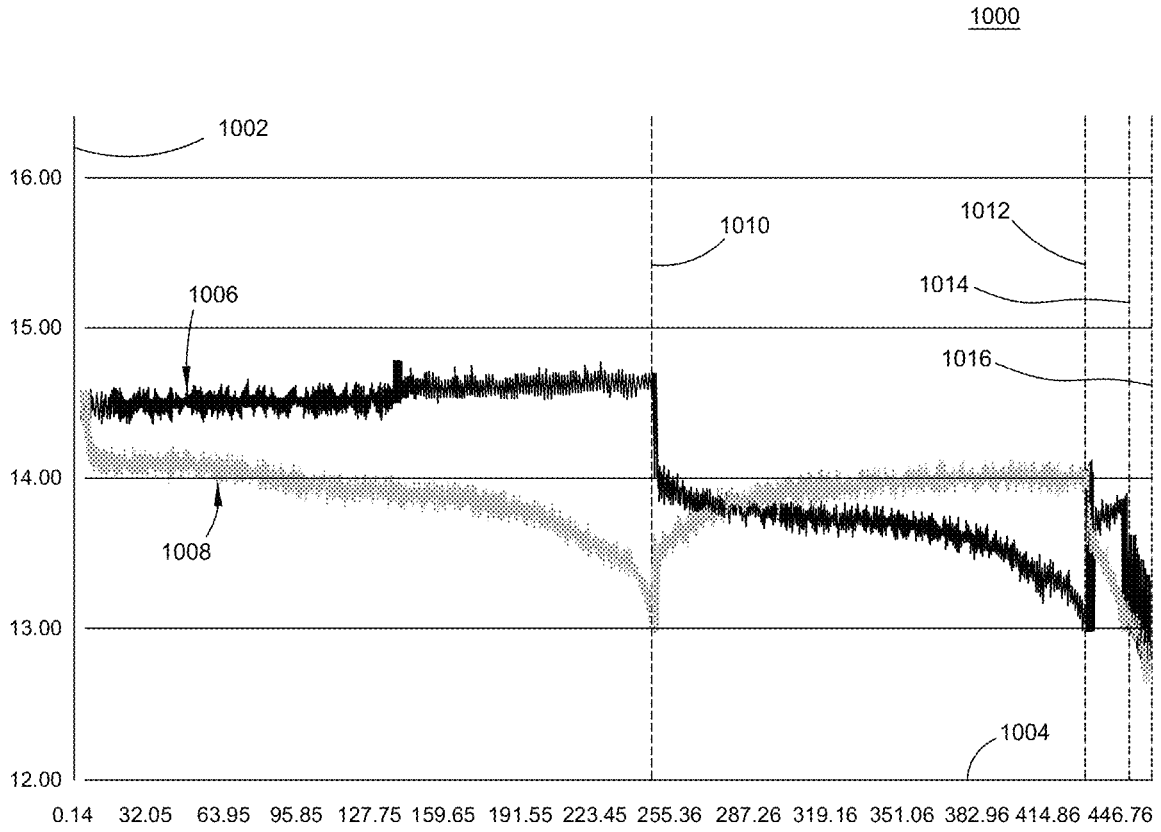
FIG. 10 shows an exemplary test of a system as shown in FIG. 9.

FIG. 10 shows an exemplary chart 1000 of a test of a system as shown in FIG. 9. In the test both the load motor and the generator motor were Nema-17 stepper motors. Each of the battery banks consisted of four HAKADI $LiFePO_4$ cells connected in series to create a nominal 12.8 Volt. The test was run using a battery manager that switches connections between the battery banks and the load and generator motors as described in reference to FIG. 9. In the chart 1000 the vertical axis 1002 represents voltage for each of the two battery banks, which are separately charted on lines 1006 and 1008. Along the bottom, the horizontal axis represents time. Both battery banks start off charged. For the sake of description, line 1006 will represent the first battery bank and line 1008 will represent the second battery bank. Initially the second load motor is connected to the second battery bank and operated at a load of 1.8 amps, and the generator motor is connected to the first battery bank. To drive the generator motor, water is pumped towards the intake manifold which results in water passing through the conduit (e.g. 108) to turn the generator motor.

The load motor discharges the second battery bank until it reaches what is considered by the battery manager to be a fully discharged state at time 1010, at which point the connections are switched; the load motor is connected to the first battery bank and the generator motor is connected to the second battery bank. As a result, the first battery bank begins to discharge and the second battery bank begins to be charged. At time 1012 the first battery bank becomes discharged, and in response, the battery manager again switches the connections back to the initial configuration, and the first battery bank begins charging and the second battery bank is discharged by the load motor. The connections are again switched at time 1014, and finally at time 1016 both batteries are fully discharged.

Figure 11:
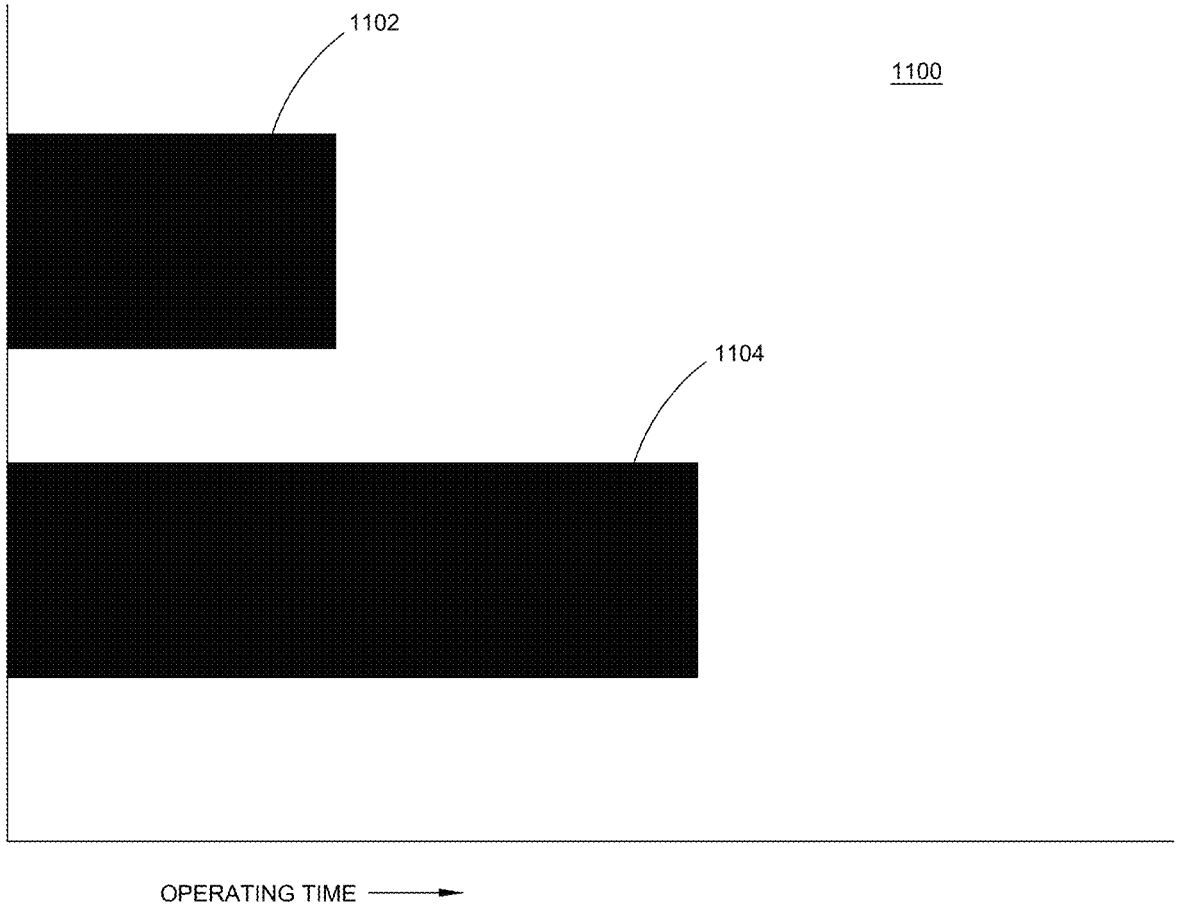
FIG. 11 shows a bar graph of an improvement in overall run time using a system in accordance with that shown in FIG. 9.

FIG. 11 shows a bar graph 1100 of a test using a system in accordance with that shown in FIG. 9 compared to using a single battery bank. The test can be similar to that shown in FIG. 10 where the battery voltages of both battery banks are charted over time. Bar 1102 shows the use of a single battery bank, without a generator, and bar 1104 shows the system of FIG. 9 in which two battery banks are used with a generator, and the load and generator connections are changed as one battery bank becomes discharged. Of course, using two battery banks, there will an increase (a doubling of operation time), but using the generator system there is more than a mere doubling of operation time as some energy can be recovered by the inventive through-hull generator system.

Thus, the inventive through-hull passive generator system allows the generation of electricity to charge a battery and/or power electrical systems on the boat while the boat is moving. The disclosed system avoids the need for a separate fuel-burning generator, it works at night when solar energy is not available, and it avoids adding super structure to the boat in the form of a wind turbine, which can interfere with activities such as fishing, for example.

The claims appended hereto are meant to cover all modifications and changes within the scope and spirit of the present invention.

What is claimed is:

1. A passive marine electrical generator system for a marine vessel that is powered by an outboard motor, comprising:

an intake manifold having an opening, the opening having an area, a wall surrounding the opening that extends upward from the opening and reduces to an intake manifold exit that is positioned over a rear of the opening, wherein the opening of the intake manifold has a front edge and sides extending from the front edge to a point at a back of the opening, and wherein the intake manifold opening has a five sided shape including a rectangular portion comprised of the front edge and having parallel opposing sides that extend towards the back of the opening to a triangular portion having sides that meet at the point centrally at the back of the opening;

a funnel member coupled to the intake manifold exit that reduces in diameter from the intake manifold exit that extends upwards and to the rear of the intake manifold to a funnel member exit;

wherein the point at the back of the opening is positioned further back than a rearmost portion of the funnel member;

a conduit having a first portion coupled to the funnel member exit, the first portion extends further upward and to the rear of the intake manifold to an elbow transition and then to a second portion which extends horizontally in a direction away from the intake manifold to a conduit exit;

an impeller disposed in the first portion of the conduit proximate to the funnel exit;

a shaft coupled to a center of the impeller at a first end of the shaft, the shaft extends from the impeller upward along the first portion of the conduit and through a sealed opening in a top of the elbow transition; and a generator mounted on top of the conduit that is coupled to a second end of the shaft.

2. The passive marine electrical generator system of claim 1, wherein the first portion of the conduit is angled at about forty degrees relative to the opening of the intake manifold.

3. The passive marine generator system of claim 1, wherein the point at the back of the opening is positioned behind the funnel portion.

4. The passive marine generator system of claim 1, wherein the parallel opposing sides extend from the front edge to halfway to the back of the opening.

5. The passive marine generator system of claim 1, further comprising a screen over the opening of the intake manifold.

6. The passive marine generator system of claim 1, wherein the conduit exit is positioned to be completely above a resting water line of the marine vessel.

7. The passive marine generator system of claim 1, wherein the intake manifold has a top wall that extends at an angle from the front edge toward the intake funnel, wherein the top wall becomes rounded from in a direction parallel to the front edge where it meets the intake funnel.

8. The passive marine generator system of claim 1, further comprising:

a charge controller coupled to the generator;

a load motor coupled to the charge controller;

a first battery bank coupled to the charge controller;

a second battery bank coupled to the charge controller; and wherein the charge controller is configured to connect the load motor to the first battery bank and the generator to the second battery bank, and then switch connections of the first battery bank to the generator and second battery bank to the load motor based on a charge state of the first and second battery banks.

9. A marine vessel, comprising:

a hull having a bottom and a transom at a rear of the hull;

an intake manifold mounted at the bottom of the hull and having an opening co-located over an opening in the hull, the opening of the intake manifold having an area, a wall surrounding the opening of the intake manifold that extends upward from the opening of the intake manifold and reduces in area to an intake manifold exit that is positioned over a rear of the opening of the intake manifold;

the opening of the intake manifold having a front edge and sides extending from the front edge to a point at a back of the opening, the intake manifold opening having a five sided shape including a rectangular portion comprised of the front edge and having parallel opposing sides that extend towards the back of the opening to a triangular portion having sides that meet at the point centrally at the back of the opening, a funnel member coupled to the intake manifold exit that reduces in area from the intake manifold exit that extends upwards and to the rear of the intake manifold to a funnel member exit;

wherein the point at the back of the intake manifold is positioned further back than a rearmost portion of the funnel member;

a conduit having a first portion coupled to the funnel member exit which extends further upward and to the rear of the intake manifold to an elbow transition and then to a second portion which extend horizontally to the rear and in a direction away from the intake manifold to a conduit exit at the transom of the hull;

an impeller disposed in the first portion of the conduit proximate to the funnel exit;

a shaft coupled to a center of the impeller at a first end of the shaft, the shaft extends from the impeller upward along the first portion of the conduit and through a sealed opening in a top of the elbow transition;

a generator mounted on top of the conduit that is coupled to a second end of the shaft;

a charge controller coupled to the generator;

a load motor coupled to the charge controller;

a first battery bank coupled to the charge controller;

a second battery bank coupled to the charge controller; and wherein the charge controller is configured to connect the load motor to the first battery bank and the generator to the second battery bank, and then switch connections of the first battery bank to the generator and second battery bank to the load motor based on a charge state of the first and second battery banks.

10. The marine vessel of claim 9, wherein the first portion of the conduit is angled at about forty degrees relative to the opening of the intake manifold.

11. The marine vessel of claim 9, wherein the parallel opposing sides extend from the front edge to halfway to the back of the opening.

12. The marine vessel of claim 9, further comprising a screen over the opening of the intake manifold.

13. The marine vessel of claim 9, wherein the conduit exit is positioned to be completely above a resting water line of the marine vessel.

14. The marine vessel of claim 9, wherein the intake manifold has a top wall that extends at an angle from the front edge toward the intake funnel, wherein the top wall becomes rounded from in a direction parallel to the front edge where it meets the intake funnel.

* * * * *